US007857737B1

(12) United States Patent
Ware et al.

(10) Patent No.: US 7,857,737 B1
(45) Date of Patent: Dec. 28, 2010

(54) OSCILLATING EXERCISE DEVICE FOR SHOULDER AND CORE STRENGTHENING

(76) Inventors: Arthur Nelson Ware, 103 Weldon Dr., Madison, MS (US) 39110; Douglas Eric Parsell, 327 Arlington Cir., Ridgeland, MS (US) 39157

( * ) Notice: Subject to any disclaimer, the term of this patent is extended or adjusted under 35 U.S.C. 154(b) by 0 days.

(21) Appl. No.: 12/590,987

(22) Filed: Nov. 18, 2009

(51) Int. Cl.
*A63B 21/02* (2006.01)

(52) U.S. Cl. ..... 482/126; 482/121; 482/39; 482/40

(58) Field of Classification Search ..... 482/11, 482/148, 108–109, 93, 23, 38–39, 121–130, 482/139, 51, 91, 907
See application file for complete search history.

(56) References Cited

U.S. PATENT DOCUMENTS

| | | | | |
|---|---|---|---|---|
| 460,270 | A | 9/1891 | Somerby | |
| 1,013,782 | A | 1/1912 | Koch | |
| 2,709,079 | A * | 5/1955 | Bubb et al. | 267/174 |
| 3,545,121 | A | 12/1970 | Misko | |
| 4,268,031 | A | 5/1981 | Schomburg | |
| 5,147,262 | A | 9/1992 | Hymanson | |
| 5,474,511 | A | 12/1995 | Dantolan | |
| 5,674,162 | A | 10/1997 | Ellingson et al. | |
| 6,319,179 | B1 | 11/2001 | Hinds | |
| 2004/0087419 | A1 * | 5/2004 | Ware et al. | 482/93 |

* cited by examiner

*Primary Examiner*—Lori Baker
(74) *Attorney, Agent, or Firm*—Workman Nydegger

(57) ABSTRACT

The disclosed device is an oscillating exercise device for strengthening of the muscles comprising the shoulder and the torso. The device is held in the user's hand and moved in an oscillating manner to simulate a sports specific movement or for muscle strengthening. The device is composed of a tube with internally threaded ends, detachable, threaded end caps, hinged clamshell handle, weight mass and elastic resistance bands. The end caps house springs that extend into the tube when screwed to the ends of the tube. The weight is of a diameter such that it may travel freely along the inner length of the tube, yet closely matched to the inner diameter of the tube such that significant air compression occurs in front of the moving weight. The generated air compression slows the velocity of the traveling weight and reduces the shock of the weight when it impacts the springs at the tube ends. An attachable handle allow for improved simulation of sports specific throwing motions. The elastic resistance bands attach to the tube by way of the clamping handle unit and provide directional resistance during sports related training exercises.

20 Claims, 3 Drawing Sheets

OSCILLATING EXERCISE DEVICE FOR SHOULDER AND CORE STRENGTHENING

CROSS-REFERENCE TO RELATED APPLICATIONS

This application claims the benefit of U.S. Provisional Application No. 61/199,373, entitled "Portable inertial trainer for rotator cuff", filed on Nov. 17, 2008, which is incorporated herein in its entirety.

FIELD OF THE INVENTION

The invention is related to shoulder strengthening devices such as free weights and elastic bands and is more particularly directed to a spring-dampened, oscillating, shoulder and torso strengthening device.

BACKGROUND OF THE INVENTION

The shoulder joint is composed of a complex system of multiple muscles, tendons and ligaments. When functioning properly, these structures stabilize the head of the humerus within the Glenoid cavity. The four rotator cuff muscles surround the shoulder joint, blend with the capsule, and grasp their four points of attachment to the humerus, thus maintaining the integrity of the joint by acting as ligaments as well as moving the humerus.

Various exercise devices have been constructed to aid in the strengthening of the muscles that form the rotator cuff. The goal of such activity is to better stabilize the head of the humerus within the Glenoid cavity, especially during times of increased external loading as experienced during a throwing motion. Utilization of weighted dumbbells such as U.S. Pat. No. 460,270 issued to Somerby and U.S. Pat. No. 1,013,782 issued to Koch can be used to isolate and strengthen the muscles of the rotator cuff. However, strengthening achieved through dumbbell exercises does not fully prepare the shoulder joint for the type of loading seen during actual throwing activity. Dumbbell training does not simulate an actual throwing motion and therefore muscular development gained through such exercises may not be fully beneficial during actual throwing activities.

One general category of devices that have been proposed to strengthen the muscles of the rotator cuff is elastic band based designs. U.S. Pat. No. 4,268,031 issued to Schomburg describes a hoop with a hand-grip in its center with multiple elastic lines connecting the central handle to the parameter of the hoop. An oscillating motion is performed in an attempt to strengthen the muscles of the rotator cuff. This design only allows for a very short range of motion compared to the very long range of motion of an actual throwing movement. Utilizing similar elastic bands, U.S. Pat. No. 6,319,179 issued to Hinds describes a system of elastic cords that may be attached to a stable frame, such as a doorway. The cords pull against the general forward movement of the users hand during a typical throwing motion. Problems with this design include an unrealistic loading pattern for the throwing motion and the need of a stable frame for attachment.

Oscillating movements of a weight can be used to strengthen the muscles of the rotator cuff Spring or metal strips can be utilized to produce the desired oscillating effect. U.S. Pat. No. 5,147,262 issued to Hymanson describes a thin metal strip that is held at its midpoint. The user moves their hand back and forth along a short linear path. The device provides acceleration and deceleration forces at the endpoints of this short range of motion movement. A drawback with this design is its inability to strengthen the appropriate muscle groups through a complete range of motion similar to one that is experienced during a throwing motion. U.S. Pat. No. 5,474,511 issued to Dantolan describes a rod with a weight that slides along the rod. Springs decelerate the moving weight as it approaches the rod handles. The handles are positioned at the ends of the rod. A problem with this design is that it does not allow for a relaxed, free-fall segment of the simulated throwing motion. Another problem concerns the inability for an accurate throwing motion to be performed given the positioning of the devices handles at the ends of a long rod. U.S. Pat. No. 3,545,121 issued to Misko describes a device similar to that of U.S. Pat. No. 5,474,511 but to be utilized as a toy rather than as a training tool. U.S. Pat. No. 5,674,162 issued to Ellingson describes a shoulder rehabilitation device that is based a design of a hollow hoop with a central hand grip where said hollow hoop contains a moveable weight. As the user generates the required hand motion to keep the weight traveling around the hoop the user's shoulder muscles are exercised. Shortcomings of this design include that it only allows for training over a relatively short range of motion and that the movements trained do not accurately simulate an actual throwing motion.

BRIEF SUMMARY OF THE INVENTION

To address the shortcomings of the available art, the present invention provides for shoulder musculature strengthening through an oscillating motion consisting of an acceleration phase, followed by a "free-fall" phase, followed by a deceleration phase. The present invention provides the ability to simulate the three phases of a natural throwing motion while controlling many variables of that motion. Variables concerning said motion that can be uniquely controlled with the present invention include the mass of the weight thrown, the length of the "free-fall" phase, the degree of impact at the terminus of the deceleration phase and the degree of wrist involvement in the motion.

According to the invention, a shoulder strengthening, oscillating device is composed of a rigid tube with springs fixed within the ends of the rigid tube and a weight mass positioned within the rigid tube and between the fixed springs. The device is used by grasping the tube and accelerating the device with the long axis of the tube oriented parallel to the direction of the user's hand movement. The shoulder complex is loaded during the acceleration phase of the movement. As the motion translates through a constant velocity phase and a deceleration phase, the weight mass within the tube slides from the back of the tube towards the front of the tube. At the endpoint of the motion, the hand has zero velocity but the weight mass continues to slide towards the spring fixed at the tube's end. As the weight mass impacts the fixed spring, the shoulder musculature must resist the forces generated due to the deceleration of the weight mass upon the spring. The cycle of the motion is completed by then performing the initial movement pattern in reverse. Once again, a three phase loading of the shoulder is experienced. The end point of the reverse motion positions the user for the start of the next training cycle. These movement patterns are performed cyclically to generate an oscillatory exercise sequence. The objective of the stated invention is to accurately and controllably simulate the forces placed upon the shoulder complex during throwing motions. Additional benefit may be obtained during device utilization through incorporation of elastic band resistance during the described exercise sequence. As such, an elastic band, as is well known in the areas of sports training and physical rehabilitation, is looped around a stationary object and the two free ends of the band are subsequently secured to the device tube by way of clamping them between the hinged, clamshell handle and the exterior wall of the main tube. Once securely fixed to the device, the elastic band is adequately tensioned by positioning the device user (and device) an appropriate distance from the utilized stationary object. As the oscillating exercise sequence is performed, additional muscular involvement will be demanded to overcome the forces generated by the stretched elastic resistance band. Both throwing and batting simulation exercises can benefit from utilization of the elastic resistance bands in conjunction with the oscillating inertial exercise device.

DETAILED DESCRIPTION OF THE INVENTION

Figure 1:
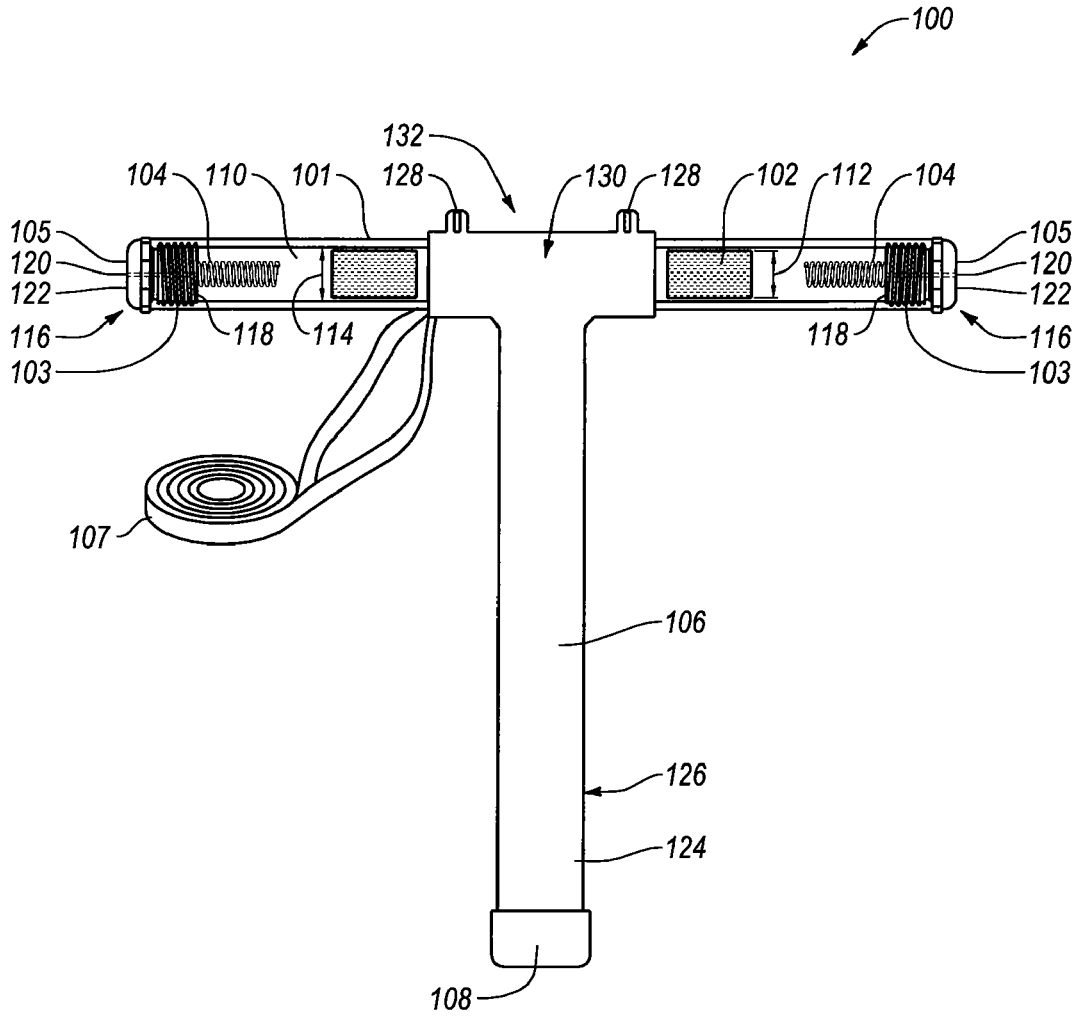
FIG. 1: Shows a side view of an assembled device.

FIG. 1 depicts a cross-sectional view of the preferred embodiment of the disclosed device 100. The device includes a main tube 101 having an internal lumen 110 that contains a weight 102 located between two springs 104 attached to opposite end caps 105. It is preferred that the difference between the diameter 112 of the weight 102 and the internal diameter 114 of the internal lumen 110 main tube 101 should be no greater than 0.06 inches.

The main tube 102 is shown to have threaded ends 103 on both of its ends 116. The threaded ends 103 threadably receive threaded end caps 105 each of which have a spring 104 fixed rigidly into their bases 118. To allow for air flow in and out of the main tube 101 when the weight 102 travels within the internal lumen 110 of the main tube 101, holes 120 are drilled in the bottom 122 of the end caps 105.

A jointed clamshell handle 106 may be attached to the main tube 101. The handle 106 has a first handle portion 124 that receives a second handle portion 126. The first handle portion 124 is hingedly coupled to the second handle portion 126 through a hinge 128 (e.g., hinged components), where two hinges 128 are shown. The first handle portion 124, second handle portion 126, and hinge 128 form the hinged clamshell 130. The hinged clam shell 130 may be secured to the main tube 101 via a hinged, clamping mechanism 132. The hinged, clamping mechanism 132 includes the two hinges 128, first handle portion 124, first handle internal surface 134, second handle portion 126, and second handle internal surface 136, where the first and second handle internal surfaces 134, 136 grip the main tube 101.

A length of elastic resistance band 107 may be secured to the main tube 101 through the mechanical clamping action of the clamshell handle 106 effectively pinning the elastic resistance band 107 between the central portion 138 of the main tube 101 and the clamshell handle 106. An end cap 108 can hold the first handle portion 124 and second handle portion 126 of the clamshell handle 106 together during device utilization.

Figure 2:
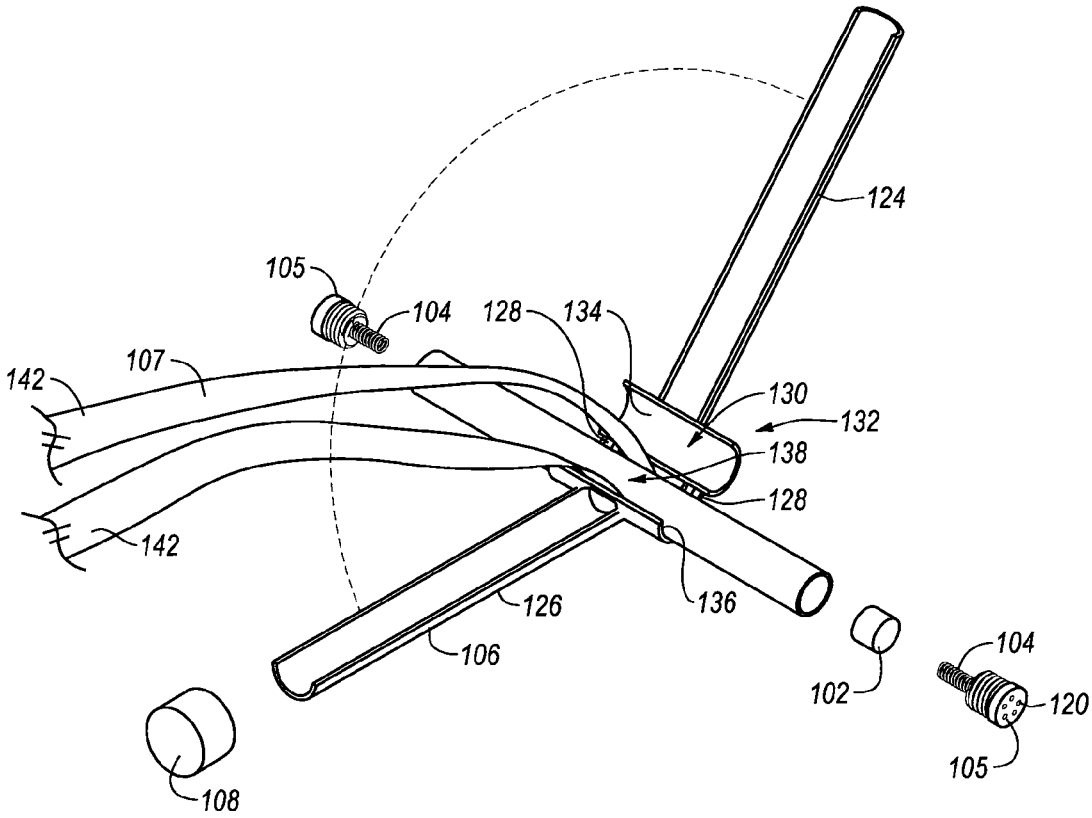
FIG. 2: Shows a perspective view of an exploded device.

FIG. 2 depicts the device 100 in a disassembled manner to greater illustrate its individual components. As can be seen from this perspective view, the elastic resistance band 107 loops around the main tube 101 of the device 100 and under the hinged clam shell 130 of the clamshell handle 106 that clamps around and onto the central portion 138 of the main tube 101. The elastic resistance bands 107 are made from polymer materials well known in the art to have adequate mechanical strength and elasticity for typical physical therapy and exercise applications.

As shown in FIGS. 1 and 2, oscillating exercise device 100 includes: a main tube 101 with internally threaded ends 103, two threaded end caps 105 that each include a spring 104 and which screw into the threaded ends 103 of the tube 101, a hinged clamshell handle 130, one or more elastic resistance bands 107, and a weight mass 102 that is of a size to travel unhindered through the internal lumen 110 of the tube 101.

The spring 104 associated with the threaded end cap 105 is securely fixed to the interior (e.g., base 118) of each end cap 105. The spring 104 is positioned centrally in relation to the center of radius of the end cap 105, with the spring's length extending parallel to the long axis of the tube when the threaded end cap 105 is attached to the tube 101.

A handle 106 is attached to the tube 101 via a clamping mechanism 132, such that the handle 106 extends substantially perpendicularly from the tube 101. The handle 106 may extend approximately twelve inches to allow for grasping the handle 106 in a manner to simulate the hand position typically utilized with a baseball bat during batting. The clamping mechanism 132 can be configured so as to provide a convenient and secure attachment of the elastic resistance band 107 to the main tube 101 by way of clamping the elastic resistance band 107 between the tube 101 and the clamped handle 106.

The end caps 105 can have one or more holes 120 that extend from the bases 118 to the bottom 122 so as to allow air to be pushed out and pulled into the tube's internal lumen 110 during device utilization.

The exercise device provides a convenient means of securely attaching one or more elastic resistance bands to the main tube. The convenient means can include the clamshell handle 106, the two hinges 128, the first handle portion 124, the first handle internal surface 134, the second handle portion 126, and the second handle internal surface 136, where the first and second handle internal surfaces 134, 136 grip the main tube 101 when the clamshell handle 106 is in the closed orientation.

Figure 3:
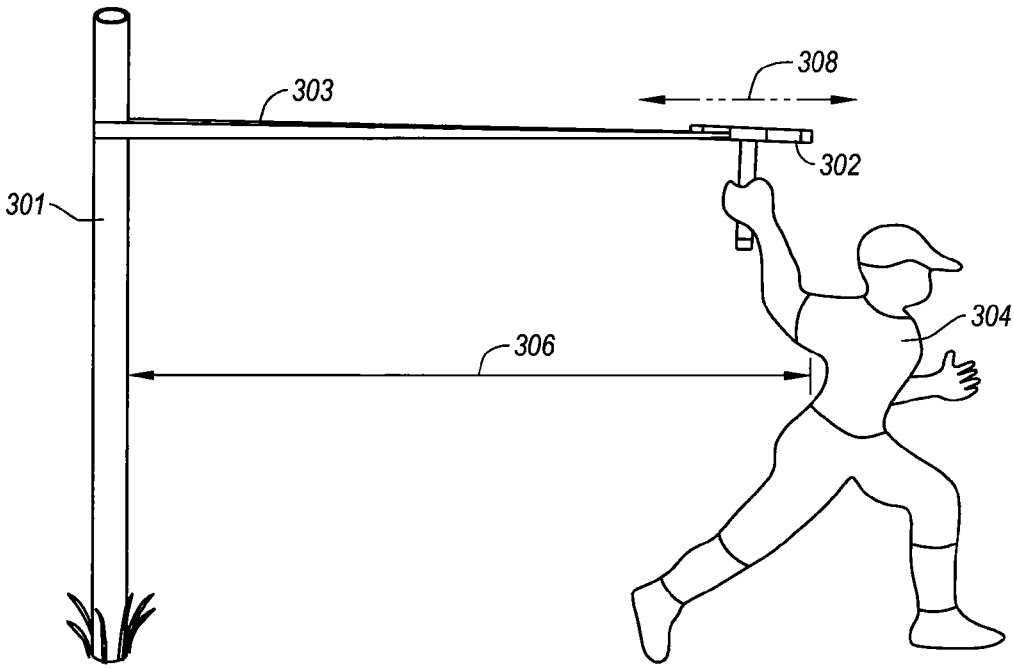
FIG. 3: Illustrates a view of the device in use.

FIG. 3 depicts a typical manner of device 302 utilization. The elastic resistance band 303 is shown looped around a stationary object 301 and securely attached to the device 302. The device user 304 typically positions themselves a sufficient distance 306 from said stationary object 301, so as to stretch the elastic resistance band 303 adequately for generation of the desired resistance during device utilization.

The device 302 can be used in a shoulder strengthening exercise by oscillating the device. The device 302 is used by grasping the clamshell handle 106 and accelerating the device 302 with the long axis 308 of the main tube 101 oriented parallel to the direction of the user's hand movement. The shoulder complex is loaded during the acceleration phase of the movement. As the motion translates through a constant velocity phase and a deceleration phase, the weight mass 102 within the main tube 101 slides from the back of the tube (e.g., one end 116) towards the front of the tube (e.g., the other end 116). At the endpoint of the motion, the hand has zero velocity but the weight mass 102 continues to slide towards the spring 104 fixed at the tube's end 116. As the weight mass 102 impacts the fixed spring 104, the shoulder musculature must resist the forces generated due to the deceleration of the weight mass 102 upon the spring 104. The cycle of the motion is completed by then performing the initial movement pattern in reverse. Once again, a three phase loading of the shoulder is experienced. The end point of the reverse motion positions the user 304 for the start of the next training cycle. These movement patterns are performed cyclically to generate an oscillatory exercise sequence.

Additional benefit may be obtained during device utilization through incorporation of elastic band resistance during the described exercise sequence. As such, an elastic band 303 is looped around a stationary object 301, and the two free ends 142 of the band 303 are subsequently secured to the device main tube 101 by way of clamping them between the first handle internal surface 134 and/or second handle internal surface 136 with the main tube 101. As the oscillating exercise sequence is performed, additional muscular involvement will be demanded to overcome the forces generated by the stretched elastic resistance band 303. Both throwing and batting simulation exercises can benefit from utilization of the elastic resistance bands 303 in conjunction with the oscillating inertial exercise device 302.

The invention claimed is:

1. An oscillating exercise device, comprising:

a tube having an internal lumen with internally threaded ends;

a weight mass of a size that fits within the internal lumen of the tube such that the weight mass can travel through the internal lumen;

two threaded end caps that screw into the internally threaded ends of the tube;

two springs coupled to the two threaded end caps such that each threaded end cap has a spring that is located within the internal lumen when each threaded end cap is threadably coupled with the internally threaded ends;

one or more elastic resistance bands; and a hinged clamshell handle configured to receive the one or more elastic resistance bands between the tube and the hinged clamshell handle, the hinged clamshell handle including:

a first handle portion having a first internal surface adapted to receive the tube and one or more elastic resistance bands;

a second handle portion having a second internal surface adapted to receive the tube and one or more elastic resistance bands; and one or more hinges coupled to the first and second handle portions such that the first and second handle portions are capable of being in an open orientation to release the tube and one or more elastic resistance bands and being in a closed orientation to grip the tube and one or more elastic resistance bands.

2. The exercise device of claim 1, wherein the spring coupled with the threaded end cap is securely fixed to a base of said cap, and wherein the spring is positioned centrally in relation to the center of radius of the end cap and extends lengthwise parallel to the long axis of the tube when the threaded end cap is attached to said tube.

3. The exercise device of claim 1, wherein the hinged clamshell handle includes a handle that is formed from the first handle portion receiving the second handle portion in the closed orientation such that the handle extends perpendicularly from the tube.

4. The exercise device of claim 1, wherein the end caps each have one or more holes through their bases to allow air to be pushed out and pulled into the internal lumen of the tube during utilization.

5. The exercise device of claim 3, wherein the handle extends about 12 inches from the tube.

6. The exercise device of claim 5, wherein the handle is configured to be grasped by a user.

7. The exercise device of claim 6, wherein the handle is configured similarly to a baseball bat handle.

8. The exercise device of claim 1, wherein the weight mass has a diameter that is about 0.06 inches smaller than a diameter of the internal lumen.

9. The exercise device of claim 1, wherein the hinged clamshell handle includes two hinges.

10. The exercise device of claim 1, further comprising a handle cap that couples the first handle portion with the second handle portion.

11. The exercise device of claim 1, wherein the one or more elastic resistance bands each have two ends.

12. The exercise device of claim 11, wherein each of the one or more elastic resistance bands has a length sufficient to wrap around a stationary object and an end received between the tube and the hinged clamshell handle when in the closed orientation.

13. The exercise device of claim 1, comprising the one or more elastic resistance bands coupled to the tube with the hinged clamshell handle.

14. A shoulder strengthening exercise comprising:

providing the oscillating exercise device of claim 1;

coupling the one or more elastic resistance bands to a stationary object;

coupling the one or more elastic resistance bands with the tube; and stretching the one or more elastic resistance bands by moving the oscillating exercise device.

15. The shoulder strengthening exercise of claim 14, further comprising oscillating the weight mass within the internal lumen.

16. The shoulder strengthening exercise of claim 15, further comprising gripping the hinged clamshell handle like a baseball bat.

17. The shoulder strengthening exercise of claim 16, further comprising swinging the oscillating exercise device like a baseball bat.

18. A oscillating exercise device, comprising:

a tube having an internal lumen with internally threaded ends;

a weight mass of a size that fits within the internal lumen of the tube such that the weight mass can travel through the internal lumen;

two threaded end caps that screw into the internally threaded ends;

two springs coupled to the two threaded end caps such that each threaded end cap has a spring that is located within the internal lumen when each threaded end cap is threaded with the internally threaded ends; and a hinged clamshell handle including:

a first handle portion having a first internal surface adapted to receive the tube;

a second handle portion having a second internal surface adapted to receive the tube; and one or more hinges coupled to the first and second handle portions such that the first and second handle portions are capable of being in an open orientation to release the tube and being in a closed orientation to grip the tube.

19. A shoulder strengthening exercise comprising:

providing the oscillating exercise device of claim 18;

gripping the hinged clamshell; and oscillating the weight mass within the internal lumen.

20. The shoulder strengthening exercise of claim 19, further comprising coupling the tube with the hinged clamshell handle such that the first and second handle portions are in the closed orientation prior to gripping the hinged clamshell.

* * * * *

UNITED STATES PATENT AND TRADEMARK OFFICE

CERTIFICATE OF CORRECTION

PATENT NO. : 7,857,737 B1
APPLICATION NO. : 12/590987
DATED : December 28, 2010
INVENTOR(S) : Ware et al.

It is certified that error appears in the above-identified patent and that said Letters Patent is hereby corrected as shown below:

Title page
Item 57, ABSTRACT, Line 16, change “handle allow for” to --handle allows for--

Column 1
Line 56, change “users” to --user’s--

Column 2
Line 11, change “devices” to --device--
Line 16, change “based a design” to --based on a design--

Column 3
Line 30, change “lumen 110 main tube 101” to --lumen 110 of main tube 101--
Line 32, change “main tube 102” to --main tube 101--

Column 6
Line 35, change “A oscillating” to --An oscillating--

Signed and Sealed this
Third Day of May, 2011

David J. Kappos

David J. Kappos
*Director of the United States Patent and Trademark Office*